United States Patent [19]

Kellerhals et al.

[11] 4,304,053

[45] Dec. 8, 1981

[54] STEAM AND HOT AIR OPERATED DRYING DEVICE AND METHOD FOR TEXTILE ARTICLES OF CLOTHING

[75] Inventors: Otto Kellerhals; Erich Manegold, both of Thalwil, Switzerland

[73] Assignee: Vereinigte Fübereien und Appretur AG, Switzerland

[21] Appl. No.: 154,307

[22] Filed: May 29, 1980

[30] Foreign Application Priority Data

Jun. 5, 1979 [CH] Switzerland ..... 5197/79

[51] Int. Cl.[3] ..... F26B 13/02

[52] U.S. Cl. ..... 34/151; 34/225; 68/5 C

[58] Field of Search ..... 34/151, 225, 233, 77, 34/37, 106; 68/5 C, 5 D, 5 E

[56] References Cited

U.S. PATENT DOCUMENTS

| | | | |
|---|---|---|---|
| 3,257,739 | 6/1966 | Wentz | 34/225 |
| 3,513,669 | 5/1970 | Nirenberg | 68/5 C |
| 3,696,523 | 10/1972 | Beeley et al. | 68/5 C |
| 3,739,496 | 6/1973 | Buckley et al. | 68/5 C |
| 4,070,876 | 1/1978 | Thompson et al. | 68/5 C |
| 4,075,875 | 2/1978 | Heidan | 68/5 D |
| 4,151,657 | 5/1979 | Jensen et al. | 34/151 |

*Primary Examiner*—Larry I. Schwartz

*Attorney, Agent, or Firm*—McGlew and Tuttle

[57] ABSTRACT

The drying device comprises a working tunnel and a drivable conveying member extending therethrough. Articles of clothing to be dried are suspended from the conveying member transversely to the direction of conveyance, by means of hangers. Hot air and steam are supplied to the working tunnel. The articles leave the tunnel without wrinkles. For this purpose, the hot air is directed into the tunnel by means of vertical nozzles which direct the air only from above. At least in the inlet section of the tunnel, steam is introduced. The downwardly air jets thus produced, sweep the articles suspended from the conveying member in the downward direction. Due to the steam content or the air jets, even polyester containing fabrics thereby become plastic enough to be swept smooth of wrinkles.

7 Claims, 3 Drawing Figures

STEAM AND HOT AIR OPERATED DRYING DEVICE AND METHOD FOR TEXTILE ARTICLES OF CLOTHING

FIELD AND BACKGROUND OF THE INVENTION

The invention relates to a steam and hot air operated drying device for textile articles of clothing, particularly for such articles made of cotton containing fabric.

Prior art devices for drying articles of clothing which were submitted to a preliminary wet cleaning treatment, comprise a working tunnel through which the articles, which are suspended by means of hangers from a drivable conveying member, are directed, and into which hot air and steam are supplied in controllable amounts, mostly by circulation. In these known devices, the hot air is blown in through suitable inlet channels, from above and from both sides, which exposes the articles to intense hot air. This, however, necessarily results in the creation of a strong air turbulence in the tunnel. Experience has shown that, even though a quick and relatively uniform drying of the articles is obtainable in this way, articles made of fabrics tending to wrinkle, such as cotton or mixed fabric of cotton and polyester, do not easily receive a desired finish, i.e, the articles leave the tunnel still considerably wrinkled and in need of an after-treatment such as ironing or the like.

SUMMARY OF THE INVENTION

The present invention is directed to a tunnel drying device and method of the mentioned kind, in which the articles of clothing are not only dried but also freed of wrinkles, so that they leave the device with a finish requiring no further smoothing.

The essence of the invention is that the hot air jets introduced into the tunnel are used not only as a medium for absorbing and removing excess moisture, but at the same time for acting on the articles of clothing mechanically, to free them from creases and wrinkles.

An object of the invention is to provide a steam and hot air operated drying device for articles of fabric comprising a housing having a working tunnel, a drivable conveyor member extending through the tunnel for carrying the articles in spaced relationship with each other, drive means connected to the conveyor to convey the articles, a hot air feeder having a pressure side and a return side for supplying hot air to the tunnel, an air distributing chamber of the housing connected to the pressure side of the hot air heater provided above the tunnel and communicating with the tunnel through a plurality of downwardly directed nozzles, a steam supply member provided upstream of at least some of the nozzles to provide steam to the nozzles whereby at least some of the nozzles provide a steam and hot air mixture to the articles of fabric to dry and smooth the articles as they are conveyed by the conveying member through the tunnel, and a bottom collecting chamber of the housing communicating with the tunnel and connected to the return side of the feeder to prevent turbulence in the air directed through the tunnel.

In this design, the air which is discharged from the nozzles is directed parallel and downwardly as jets which sweep the articles of clothing only from above downwardly and, due to the removal of the air through the apertures in the bottom, no disturbing turbulences are produced in the tunnel in practice. Such sweeping with hot air jets, which are unidirectional in themselves and parallel to each other, and with the steam supplied to the nozzle producing the hot air jets, which supply is effected along about two thirds of the tunnel length, not only ensures a completely satisfactory absorption and removal of the excess moisture from the articles of clothing, but also simultaneously produces a uniform smoothing effect on the articles during the entire drying operation, without causing damage by overheating. Advantageously, the articles are conveyed stepwise, with the steps and the periods of dwell being adjustable.

Here again, of course, as in the prior art devices, the tunnel may be subdivided into several working zones, with an additional supply of steam at least in the initial zone or zones (considered in the direction of conveyance). However, unlike in the prior art, the steam is not sprayed at some central location directly into the respective tunnel zone, but is uniformly distributed to the nozzles associated with that steam zone. This insures that the steam passes to the article of clothing along with the air jet so that damage by overheating, especially of polyester containing mixed fabrics, can be prevented, while on the other hand, the above-mentioned smoothing effect of the air jets is preserved.

A further object of the present invention is to provide a method of drying and smoothing articles of fabric or clothing using steam and hot air.

A still further object of the invention is to provide a steam and hot air operated drying device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
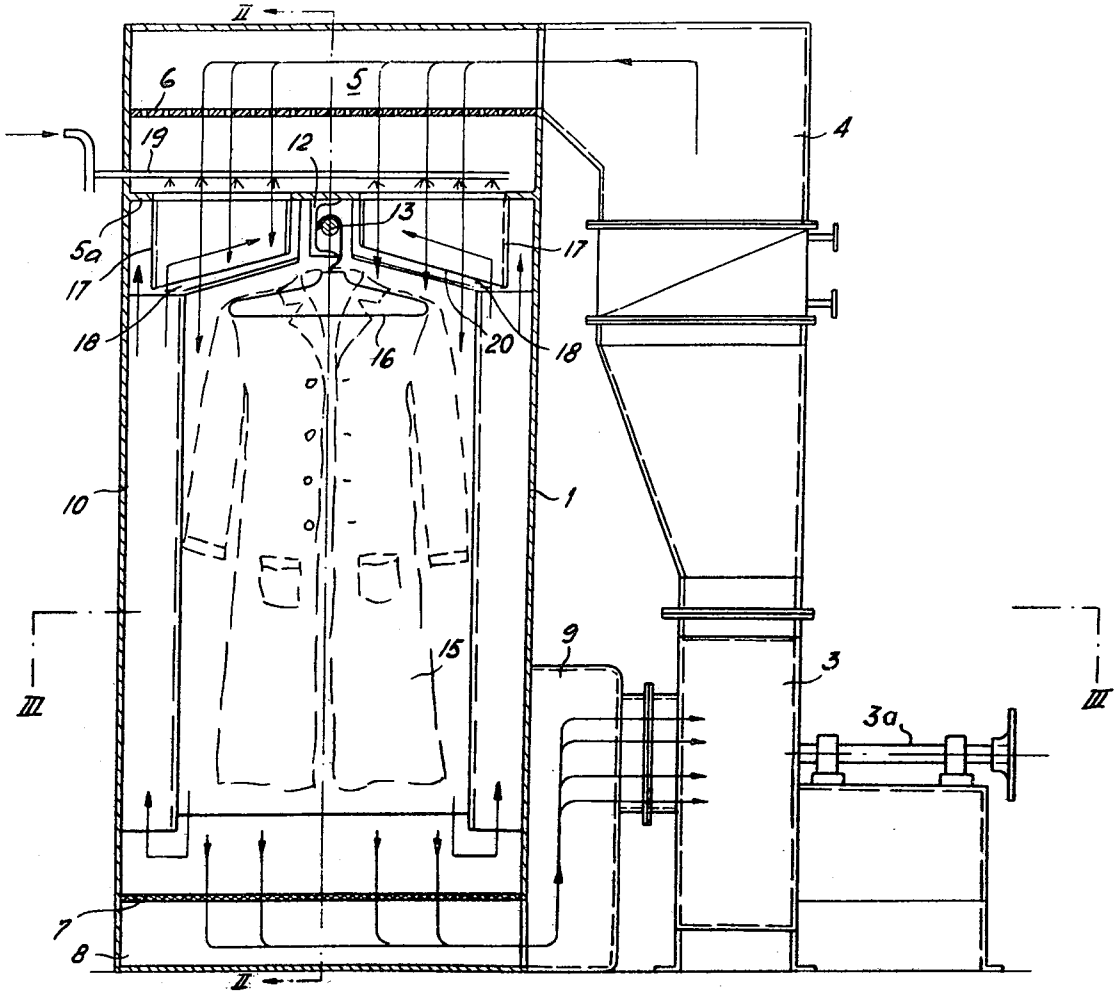
FIG. 1 is a vertical sectional view of the inventive device.

The shown device comprises a box-shaped housing 1 in which a tunnel 2 which is open in the longitudinal direction, is formed between an inlet and an outlet section *2a, 2b*. Laterally of the tunnel, a hot air feeding blower 3 is disposed whose pressure side communicates through a vertical duct 4 with a distributing chamber 5 which is provided in housing 1 above the top wall 5*a* of tunnel 2. Blower 3 is powered by means 3*a* such as a shaft and sprocket which may be driven by a motor. A screen-like intermediate member 6 in distributing chamber 5 ensures a uniform distribution of the air to be fed from this chamber 5 to the nozzles which are described in more detail hereinafter. Another intermediate member 7, at the lower end of tunnel 2, which is also designed as a screen with apertures through which tunnel 2, communicates with an air collecting chamber 9 which, in turn, is connected through a duct 9 to the suction side of blower 3.

Figure 2:
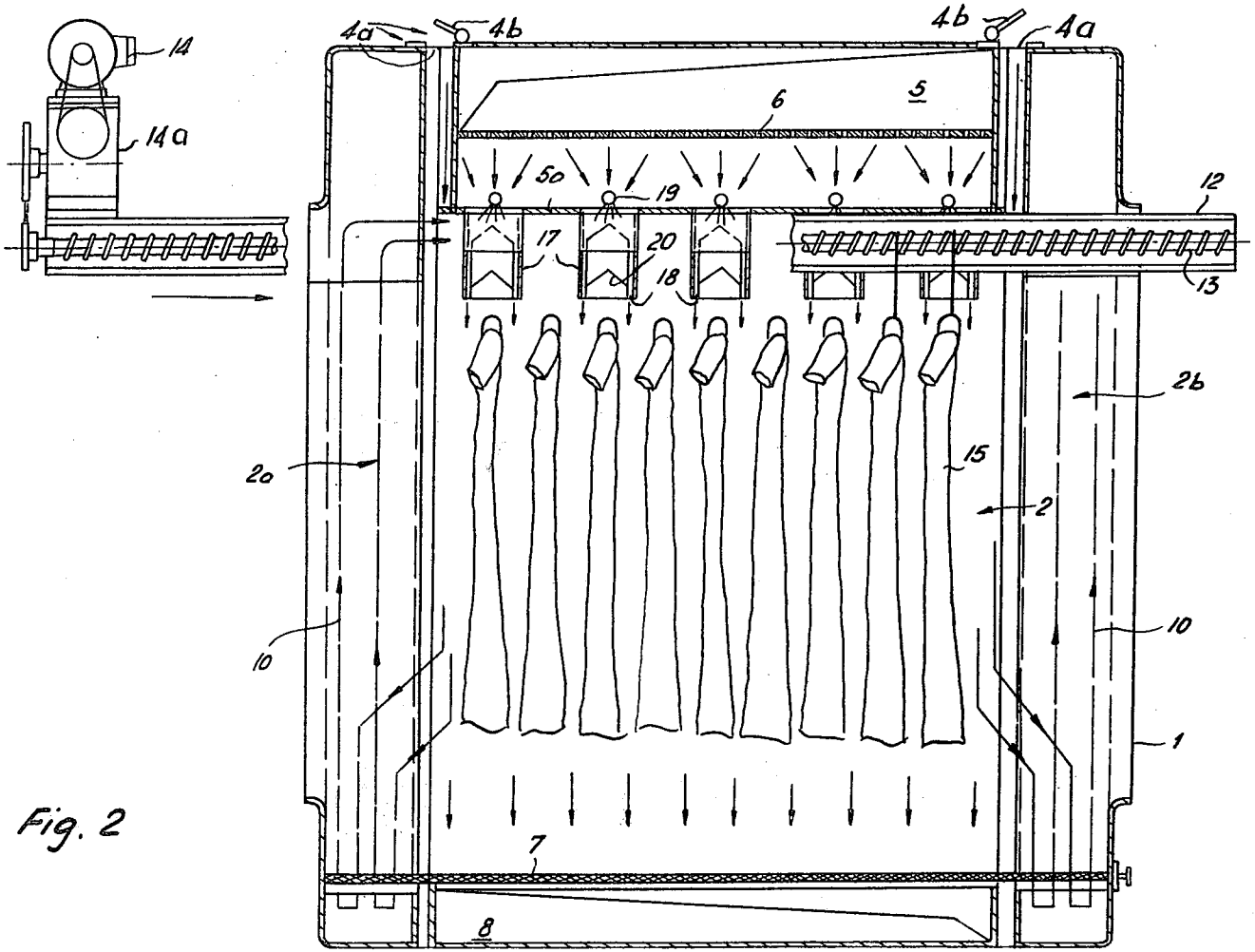
FIG. 2 is a vertical sectional view taken along the line II—II of FIG. 1.
Figure 3:
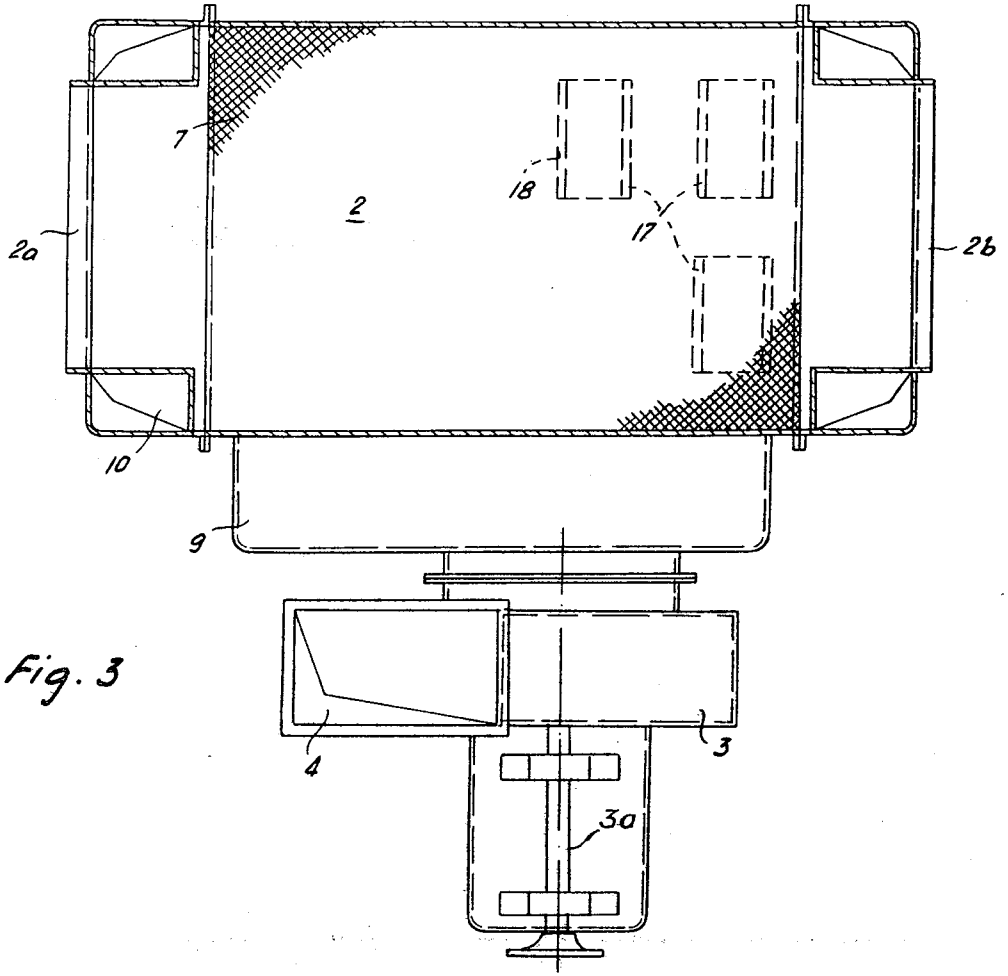
FIG. 3 is a horizontal sectional view taken along the line III—III of FIG. 1.

An air flow circuit is thereby established into which, as shown in FIG. 2 at 4*a*, fresh air can be admitted through adjustable inlet valves 4*b* to compensate for air losses through inlet and outlet sections 2*a*, 2*b*, and to replace intentionally evacuated humid air with relatively dry fresh air. Vertical connection ducts 10 which permit a direct recycling of the air from the lower part of the tunnel to the upper tunnel part, are further provided in the zone of inlet and outlet sections 2*a*, 2*b* as will be explained later.

Beneath the top wall 5*a*, a C-shaped guide rail 12 and a conveying spindle 13 extend to the longitudinal central plane of the tunnel. Spindle 13 projects from both sides of the housing at inlet and outlet sections 2*a*, 2*b* and is drivable by a motor 4 through a transmission 14*a*. The drive may be effected continuously or periodically and may be adjusted as to the speed and periods of run and dwell. As shown in FIG. 1, the hangers 16, supporting the articles of clothing 15 are suspended by their hooks from between the individual threads of spindle 13, at equal distances and transversely to the direction of conveyance. The rotation of spindle 13 thus advances hangers 16 with clothing 15 through tunnel 2.

Nozzle boxes 17 are fixed to the top wall 5*a* which is provided with openings at these locations. Boxes 17 are positioned at both sides of spindle 13. In boxes 17, two vertically downwardly directed flat nozzles 18 extending transversely to the direction of conveyance, are formed by inserted metal sheet forms 20. Transversely extending spray pipes 19 are provided directly above nozzle boxes 17 above each two flat nozzles 18, which are connected to a steam supply. Steam may be directly fed to nozzles 18 through all of the spray pipes 19 or through only a part of them, as needed. The nozzles 18 of the nozzle groups provided at both sides of conveying member 13 are aligned with each other. All nozzles 18 of one group are equidistantly spaced from each other. This spacing somewhat exceeds the width of the articles 15 on hangers 16 in the direction of conveyance. This makes it possible, as shown in FIG. 2, to bring each of the articles 15 which are suspended from conveying member 13 at relatively small mutual distances and out of contact with each other, into a position between two consecutive pairs of flat nozzles 18. However, it is by no means necessary that the articles be advanced in steps corresponding to this spacing of nozzles.

The device operates as follows:

The hot air fed from vertical duct 4 through distributing chamber 5 to nozzle boxes 17 (where, at least in an initial zone, it is enriched with steam from spray pipes 19) is blown by flat nozzles 18 in the form of narrow, vertical air jets downwardly, parallel to articles 15 suspended from conveying member 13, so that it necessarily sweeps over the faces of the articles. Since the air can freely escape downwardly through screen bottom 7, no air surge zones occur in tunnel 2 in practice. Consequently, the articles are exposed to completely uniformly directed air jets. This results, within a relatively short period of time, in a satisfactory absorption of the moisture from all parts of the uniformly swept articles, with the sweeping by the air jets having at the same time, a mechanical effect of smoothing the fabric. By advancing the articles stepwise, the articles move sequentially past all of the nozzles and leave the outlet section 2*b* in a dry and smooth state.

The relatively strong, uniformly directed air jets from flat nozzles 18 may cause some underpressure at the top, around nozzle boxes 17, which may disturb the air jets already in the upper zone of the articles. In the inventive device, this is prevented by providing that the air from the lower part of the tunnel can return to the upper part directly, through short circuit ducts 10 as shown in FIGS. 1 and 2. At the same time, this underpressure is utilized for taking in fresh air through inlets 4*a*, whereby the pressure in the zone of nozzle boxes 17 is sufficiently equilibrated to prevent the mentioned disturbances or turbulence of the air jets.

It should be noted in addition that the number of nozzle boxes in the inventive device as well as the size and number of the sections operating with steam, or only with hot air, may be varied.

In any case, even with articles of clothing made of fabrics which are relatively strongly creased after a wet treatment, and are to be dried, the intentional unidirectional sweeping with air jets produced by downwardly directed nozzles results, already after a single passage through the device, in a smooth finish which renders any further smoothing unneccessary.

As a matter of course, circular nozzles may also be provided instead of the flat nozzles extending transversely to the direction of conveyance. Such circular nozzles projecting into the tunnel may be uniformly distributed or arranged in rows or groups.

Experience has shown that with a temperature of about 180° in the tunnel space, due to the steam addition, the articles of clothing can be kept at a temperature of about 135° to to 140° C., which makes it possible to use the air jets even for sweeping smooth polyester-containing fabrics.

While a specific embodiment of the invention has been shown and described in detail to illustrate the application of the principles of the invention, it will be understood that the invention may be embodied otherwise without departing from such principles.

What is claimed is:

1. A steam and hot air operated drying device for articles of fabric, comprising, a housing having a working tunnel, a drivable conveying member extending through the tunnel for carrying the articles in spaced relationship with each other, drive means connected to said conveying member for conveying the articles through the tunnel, a hot air feeder having a pressure side and a return side for supplying hot air, said housing defining an air distributing chamber connected to the pressure side of the hot air feeder and positioned over the tunnel and communicating with the tunnel through a plurality of vertically downwardly directed nozzles, a steam supply member in at least some of the nozzles for supplying steam with the hot air directed through the nozzles into the tunnel whereby the articles which are conveyed through the tunnel are dried with steam containing hot air directed from above and downwardly past the articles, the housing defining a collecting chamber below the tunnel and communicating with the tunnel to receive the hot air therefrom, the collecting chamber connected to the return side of the feeder, the tunnel having a top wall which has a plurality of openings therethrough, a nozzle box extending from each of the openings disposed on either side of the conveying member each nozzle box defining a pair of spaced apart flat nozzles extending transversely to the conveying member.

2. A drying device according to claim 1, wherein the steam supply member comprises a steam supply pipe extending transversely to the conveying member and adjacent and above each pair of nozzles so that each steam supply pipe supplies steam to a pair of nozzles on each side of said conveying member.

3. A device according to claim 1 including a metal sheet form in each of said nozzle boxes for defining said flat nozzles.

4. A drying device according to claim 1 including at least one fresh air inlet connected to the tunnel near the top thereof for admitting fresh air to the tunnel.

5. A drying device according to claim 1 including at least one short circuit duct in said tunnel communicating a lower part of the tunnel with an upper part thereof, the duct spaced from the nozzle boxes.

6. A drying device according to claim 1 wherein the conveying member comprises a threaded spindle, the articles of fabric carried on hangers having hooks hooked between individual threads of the threaded spindle and suspended therefrom.

7. A drying device according to claim 1 including an aperture screen connected between the distributing chamber and the tunnel and between the tunnel and the collecting chamber.

* * * * *